United States Patent [19]

Schrader et al.

[11] Patent Number: 4,733,513

[45] Date of Patent: Mar. 29, 1988

[54] TYING BAR FOR CONCRETE JOINTS

[76] Inventors: Ernest K. Schrader, 1255 Magnolia Dr., Walla Walla, Wash. 99362; Robert F. Oury, Rte. 1, 100 Freeman Rd., Gilberts, Ill. 60136

[21] Appl. No.: 921,594

[22] Filed: Oct. 21, 1986

[51] Int. Cl.[4] ..... F04B 1/48; E01C 11/14; E04F 15/14

[52] U.S. Cl. ..... 52/396; 404/56; 404/59; 404/67

[58] Field of Search ..... 404/60, 61, 67, 59, 404/56; 52/396

[56] References Cited

U.S. PATENT DOCUMENTS

| | | | |
|---|---|---|---|
| 2,106,095 | 4/1935 | Heltzel . | |
| 2,255,599 | 9/1941 | Olmsted | 404/60 |
| 2,299,670 | 10/1942 | Westcott . | |
| 2,305,979 | 12/1942 | Mitchell | 52/396 X |
| 2,358,328 | 9/1944 | Heltzel . | |
| 2,365,550 | 12/1944 | Heltzel | 404/59 |
| 2,494,869 | 1/1950 | Godwin . | |
| 2,575,247 | 11/1951 | Carter . | |
| 3,329,072 | 7/1967 | Rice | 404/59 |
| 3,397,626 | 8/1968 | Kornick et al. . | |
| 3,559,541 | 2/1971 | Watstein . | |
| 3,698,292 | 10/1972 | Koester . | |
| 4,449,844 | 5/1984 | Larsen . | |

FOREIGN PATENT DOCUMENTS

| | | | |
|---|---|---|---|
| 59171 | 9/1982 | European Pat. Off. | 404/60 |

*Primary Examiner*—Alfred C. Perham

*Attorney, Agent, or Firm*—Allegretti, Newitt, Witcoff & McAndrews, Ltd.

[57] ABSTRACT

An improved dowel or tying bar and joint construction for transferring stresses across a joint between concrete slabs or structures and accommodating for shrinkage and expansion of concrete. The bar has a resilient facing attached to at least one side of the bar so that the concrete slab or structure can move in relationship to the bar in a direction substantially perpendicular to the resilient facing. The bar is arranged across the joint in a direction substantially perpendicular to the axis defined by the joint.

26 Claims, 7 Drawing Figures

TYING BAR FOR CONCRETE JOINTS

BACKGROUND OF THE INVENTION

This invention relates to dowel and tying bars, and to construction joints for transferring stresses across a joint between concrete constructions.

Concrete responds to changes in temperature and moisture when movement associated with these changes (or for other reasons such as internal chemical reaction) is restrained, stresses develop that can lead to cracking. To control cracking, joints are built at intervals short enough to hold stresses below critical values. Transverse joints are saw cut, placed through induced cracking, or formed at spacings from 12 to 40 feet for a typical concrete highway pavement.

Concrete pavements for highways, airport runways and the like are generally placed in strips or lanes with a longitudinal joint formed between adjacent strips or lanes. Concrete is poured in the first strip and allowed to cure. Subsequently, concrete is poured and cured in the adjacent strip and so on until the concrete pavement is completed. A longitudinal joint is formed between adjacent strips to facilitate construction and to reduce stresses and control cracking caused by contraction or expansion of the concrete.

Similarly, joints are formed in concrete structural slabs, walls, footings and the like to minimize stresses and/or simplify construction methods. Of these joints, there are several types. The contraction joint minimizes uncontrolled cracking due to changes in temperature and moisture. The expansion joint provides a space between slabs to allow for expansion or swelling of the slab as temperature and moisture increase or growth due to any cause occurs. A construction joint provides a finished edge or end so that construction operations interrupted for some length of time may be continued or resumed without serious structural penalty.

Load is transferred across a joint principally by shear. Some bending moment may be transferred across the joint through tied joints that remain closed. Good load transfer capability must be built into the joint, or the joint will wear and the load carrying ability of the concrete slab or structure will be reduced. The alternative is to strengthen the concrete by improving support or increasing depth to minimize the joint load transfer weakness.

Tie bars and dowels are often used in concrete design to improve load transfer at the joint between concrete slabs or structures. Such tie bars and dowels are embedded in the concrete and arranged across the joint in a direction substantially perpendicular to the axis defined by the joint. Various approaches, depending on the type of tie bar or dowel, have been suggested with respect to concrete construction joints such as set forth in the disclosure of the following patents:

| Reg. No. | Inventor | Title |
|---|---|---|
| 2,106,095 | Heltzel | Expansion Joint |
| 2,299,670 | Wescott | Dowel Bar Structure |
| 2,358,328 | Heltzel | Joint |
| 2,494,869 | Godwin | Dowel Assembly for Concrete Road Joints |
| 2,575,247 | Carter | Sealed Joint for Concrete Slab Road Pavement |
| 3,397,626 | Kornick et al. | Plastic Coated Dowel Bar for Concrete |

-continued

| Reg. No. | Inventor | Title |
|---|---|---|
| 3,559,541 | Watstein | Concrete Joint Load Transfer Device |
| 3,698,292 | Koester | Expansion Gap Sealing Device |
| 4,449,844 | Larsen | Dowel for Pavement Joints |

The functions of the tie bars and dowels are to keep contiguous sections of concrete in alignment during contraction and re-expansion, and to transfer shear stresses and bending moments across the joint between the two slabs. The prior art dowels are often made smooth, lubricated, or coated entirely with plastic as disclosed in Kornick et al., U.S. Pat. No. 3,397,626 to prevent the dowel from bonding to the concrete and allow the concrete slab or structure to slide relative to the dowel in a direction substantially perpendicular to the axis defined by the joint. Such movement of the slab relative to the dowel prevents build up of stress in the dowel that may result in cracking of the concrete.

In an alternative construction as disclosed in Larsen, U.S. Pat. No. 4,449,844, the dowel has its outer ends bonded to concrete and its central portion covered with plastic to prevent bonding to concrete. The dowel disclosed in Larsen performs a latent spring function to limit the movement of the concrete slab relative to the dowel when temperature changes cause the length of the slab section to vary with time.

A major disadvantage of the prior art dowels and tie bars is that the dowels and tie bars prevent movement of the concrete slab relative to an adjacent concrete slab in a direction substantially parallel to and aligned with the axis defined by the joint. In such situations, the dowels and tie bars provide enough restraint against movement and shrinkage so that the concrete slab or structure induces stresses along a line substantially defined by ends of the dowels or tie bars. This problem is most evident in the situation when adjacent concrete slabs or strips are placed and cured in repetitive order or when adjacent concrete slabs or structures are subjected to extreme temperature differences.

For example, it is well known that concrete typically shrinks after placement. If a second concrete paving slab is placed adjacent to a first concrete paving slab that has contracted from thermal and drying shrinkage, the second concrete paving slab will likewise attempt to shrink similar to the shrinkage of the first concrete paving slab. However, dowels and tie bars arranged across the joint between the first and second concrete paving slabs will restrain the second concrete paving slab from shrinking during curing. The developed internal stress in the second concrete paving slab can create an undesirable condition that may result in cracking. Even if cracks do not develop, the internal stresses are added to the stress from the normally applied design loads and could reduce the service life of the pavement. FIG. 1 illustrates cracks that could develop in such situations.

Many of the prior art joint constructions are preoccupied with resisting movement in two dimensions (dowel) or three dimensions (tie bar). The prior art dowels and tie bars do not restrain movement in one dimension and two dimensions, respectively, which would reduce the cracking problems associated with adjacent concretes moving relative to each other in a direction aligned with the joint axis and still maintain the outer surface of the contiguous sections of concrete in alignment during contraction and re-expansion. The present invention overcomes such prior art shortcomings.

SUMMARY OF THE INVENTION

The present invention relates to improved dowel and tying bars, and joint construction for transferring stresses across a joint between concrete slabs or structures and accommodating relative movements such as occur from drying shrinkage and thermal contraction. The tying bar is either a dowel or a tie bar. The tying bar is embedded in the concrete slabs or structures and has sides that are arranged across the joint in a direction substantially perpendicular to an axis defined by the joint. The tying bar has a resilient facing attached to either one side or opposite sides of the tying bar so that the concrete slab or structure can move in relationship to the tying bar in a direction substantially perpendicular to the resilient facing and substantially aligned with the joint axis. The resilient facing is a plastic, rubber or similar material.

The improved tying bar significantly reduces stresses caused by concrete shrinking or expanding and moving against an anchored tying bar in a direction substantially perpendicular to the resilient facing. While doing this, the improved tying bar simultaneously prevents movement of the concrete in a direction substantially perpendicular to the concrete surface penetrated by the bar and parallel to the resilient material, thereby maintaining the outer surfaces of adjacent or contiguous concretes in alignment during contraction and re-expansion.

Consequently, it is an object of the invention to provide an improved dowel or tying bar and joint construction for transferring stresses and bending movement across a joint between concrete slabs or structures.

Still a further object of the invention is to provide an improved dowel or tying bar and joint construction to accommodate expansion and shrinkage of the concrete slabs or structures that are placed adjacent to previously cured concrete slabs and structures.

Another object of the invention is to provide an improved dowel or tying bar and joint construction that will accommodate movement of the concrete slabs or structures in a direction substantially aligned with the axis defined by the joint between adjacent concrete slabs or structures.

Yet a further object of the invention is to provide an improved dowel or tying bar and joint construction that will reduce internally developed stresses and resulting cracking of concrete slabs or structures caused by differences and/or changes in temperature and moisture between adjacent concrete slabs and structures or by other stresses that are externally or internally developed including those from shrinkage compensating concrete.

A further object of the invention is to produce an improved dowel or tying bar and construction joint that can be fabricated and installed at a low cost and can reduce the maintenance costs of concrete slabs or structures.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

The preferred embodiments of the invention will be described in view of dowel bars and joint construction used in connection with concrete pavements. The dowel bars and joint construction of the present invention is not limited to concrete pavement construction but is also applicable to dowel or tying bars and joint construction used in connection with concrete structures, slabs, walls, footings and the like. The concrete may be either reinforced, unreinforced or prestressed and concrete made with or without shrinkage compensating cement.

Figure 1:
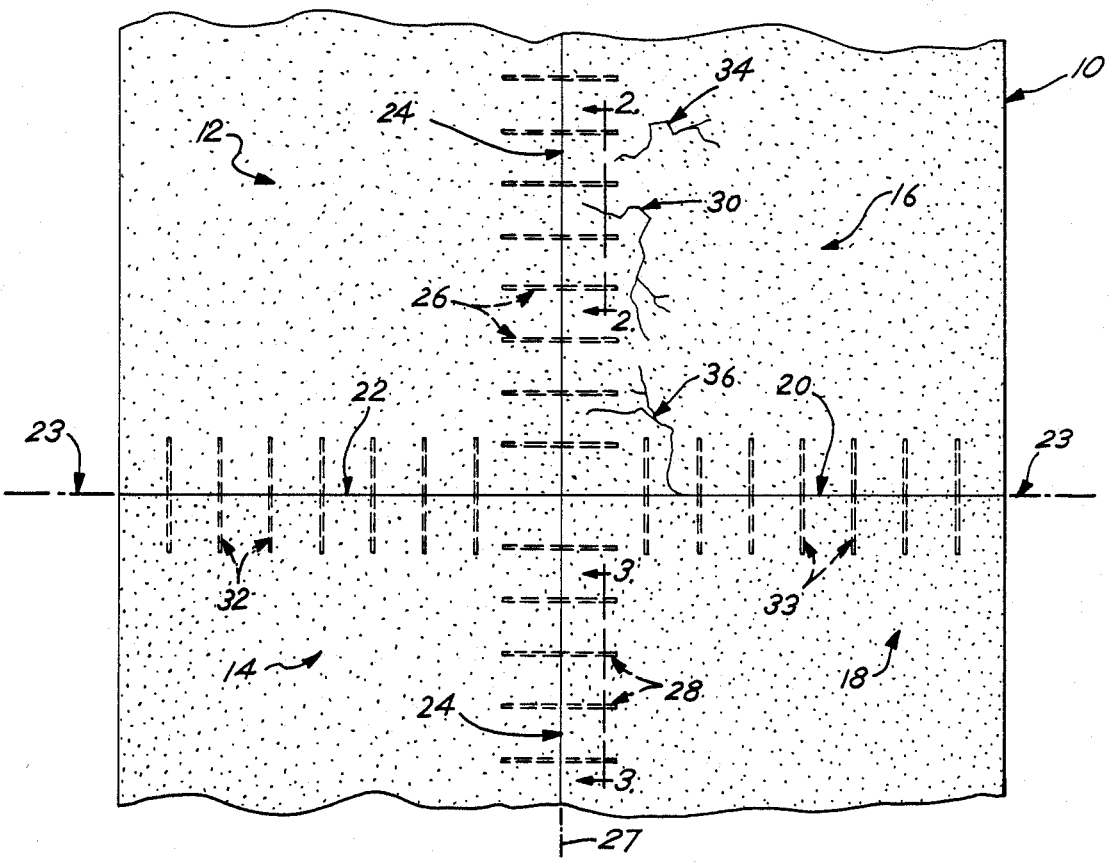
FIG. 1 is a top plan cross sectional view depicting the joint construction of a concrete slab formed in sequential stripes.
Figure 2:
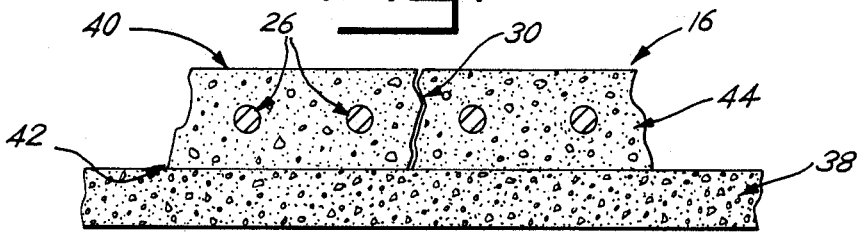
FIG. 2 is a cross sectional side elevation of the prior art dowel bars of the concrete slab depicted in FIG. 1.
Figure 3:
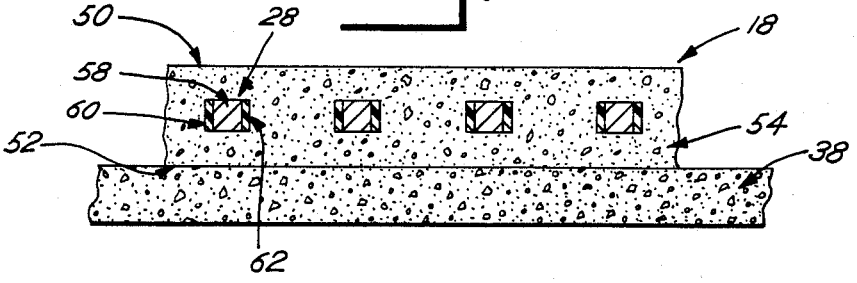
FIG. 3 is a cross sectional side elevation of dowel bars of the present invention for the concrete slab depicted in FIG. 1.

FIGS. 1 through 3 depict a typical concrete pavement 10 consisting of first concrete slabs 12, 14 and second concrete slabs 16, 18 poured in sequence over a supporting base or subgrade 38. That is, the first concrete slabs 12, 14 will be placed before the adjacent second concrete slabs 16, 18 are placed. Transverse joints 20, 22 are saw cut, placed through induced cracking or formed through methods well known in the art to reduce stresses in the concrete and prevent cracking. A longitudinal joint 24 is formed between the two concrete strips comprising first concrete slabs 12, 14 and the second concrete slabs 16, 18.

The dowel bars 26, 28, 32 and 33 embedded in the concrete slabs may also be tie bars. The dowel bars 26, 32 and 33 for concrete pavements are typically formed from smooth steel rods having a diameter on the order of ½ inch to 2 inches and lengths of one and one half to four feet. The diameters and lengths of the bars vary depending on the type of installation and the required counteracting forces to match the forces tending to change the lengths of the concrete slabs. When the bars are rough or deformed instead of smooth (to prevent easy pullout), they are commonly referred to as tie bars.

The bars are placed and supported with respect to a joint in the concrete slabs. As shown in FIG. 2, the bars 26 are often located centrally between the outer surface 40 and the lower surface 42 of the concrete layer 44.

As depicted in FIG. 1, dowel bars 32 are embedded in the first concrete slabs 12, 14 and arranged across the transverse joint 22 in a direction substantially perpendicular to the axis 23 defined by transverse joint 22. Similarly, dowel bars 33 are embedded in the second concrete slabs 16, 18 and arranged across the transverse joint 20 in a direction substantially perpendicular to the axis 23 defined by the transverse joint 20.

As further depicted in FIGS. 1 and 2, the prior art dowel bars 26 are embedded in the first concrete slab 12 and the second concrete slab 16, and are arranged across the longitudinal joint 24 in a direction substantially perpendicular to the axis 27 defined by longitudinal joint 24. In the typical installation, dowel bars 26 are centrally positioned, and the concrete slab 12 is poured; the concrete slab 12 hardens with the bars embedded therein in situ.

After the first concrete slab 12 has undergone expansion or contraction from thermal or drying shrinkage, the second concrete slab 16 is placed adjacent to the first concrete slab 12 so that the bars 26 are also centrally embedded in the second concrete slab 16. The second concrete slab 16 will attempt to shrink during curing similar to the shrinkage of the first concrete slab 12.

However, in the conventional installation, the bars 26 arranged across the longitudinal joint 24 between the first and second concrete slabs will restrain the second concrete slab 16 from movement. The developed internal stress in the second concrete slab 16 can create an added stress which may cause cracking by itself or when added to an applied load upon the slab. The cracks will often develop along a line near the ends of the dowel bars 26. FIGS. 1 and 2 illustrate such a longitudinal crack 30, transverse crack 34 or corner crack 36 that may develop in the stressed situations of conventional installations.

Figure 4:
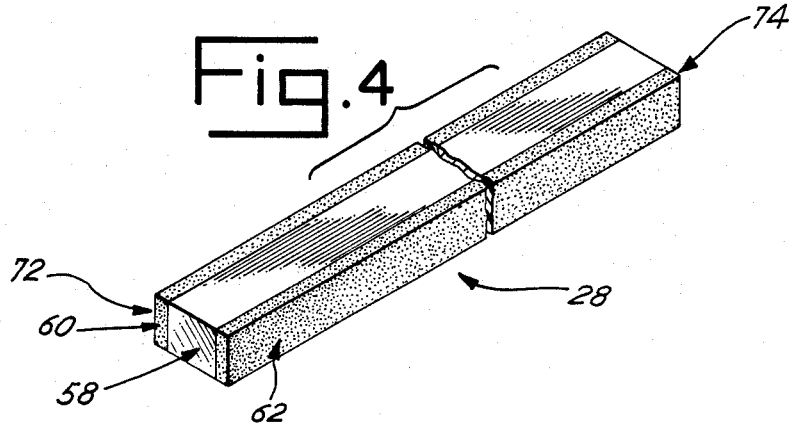
FIG. 4 is a perspective view of the dowel bar of the present invention.
Figure 5:
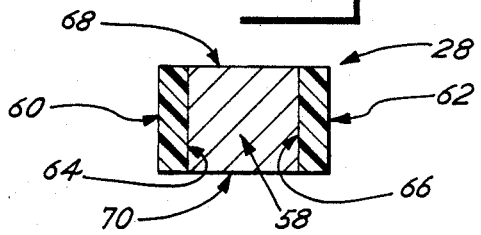
FIG. 5 is a cross sectional view of the dowel bar depicted in FIG. 4.
Figure 6:
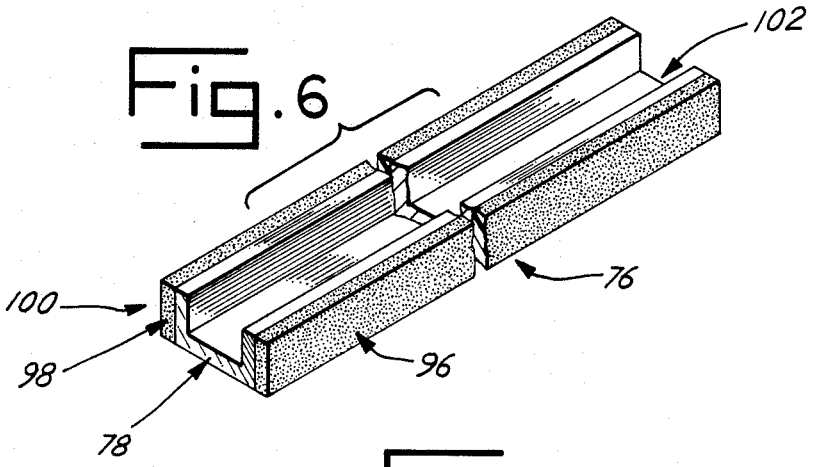
FIG. 6 is a perspective view of one alternative embodiment of the dowel bar of the present invention.
Figure 7:
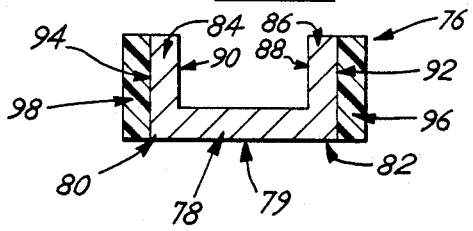
FIG. 7 is a cross sectional view of the dowel bar depicted in FIG. 6.

The present invention depicted best in FIGS. 3 through 7 overcomes the shortcomings in the conventional installations relative to stress cracks formed when adjacent concrete strips are placed at different times or have different relative movements. One embodiment of the invention is shown in FIGS. 3 through 5. Another embodiment is shown in FIGS. 6 and 7.

Referring to FIGS. 3 through 5, each dowel bar 28 consists of a bar 58 having resilient facings 60, 62. The bar 58 is formed from steel bars having a cross section defining a substantially rectangular shape although other shapes may be used. The bar 58 may be a standard square steel reinforcing bar. The bar 58 is sized, depending on the type of installation, to accommodate bending moments and applied shear loads.

For typical concrete paving slabs, the bar 58 would have a cross section on the order of ½ to 2-inch square and a length on the order of 2 to 4 feet.

The bar 58 is generally located centrally between the outer surface 50 and the lower surface 52 of the concrete layer 54 as shown in FIG. 3. The bar 58 has sides 64, 66, a top surface 68, a bottom surface 70, a first end 72 and a second end 74. The sides 64, 66 of the bar 58 are embedded in the concrete slabs 14 and 18 and arranged across the longitudinal joint 24 in a direction substantially perpendicular to the axis 27 defined by the longitudinal joint 24.

The bar 58 has resilient facings 60 and 62 attached to sides 64 and 66, respectively. In alternative embodiments (not shown), the resilient facing may be attached to only one side or additionally to the ends of the bar. The resilient facings are preferably formed from compressible polyethylene. Other compressible materials that could be used include polyurethane, polyvinyl chloride, styrofoam, asphalt impregnated cardboard, or the like. The compressible materials must be of sufficient rigidity so as to not compress when the concrete is poured, wet and uncured but to compress when stresses caused by contraction and/or expansion of the concrete takes place, for example, thermal and drying shrinkage of the concrete. Such compressible materials would be the closed cell type when used in cold climates to prevent water from impregnating the compressible material and freezing at cold temperatures.

The resilient facings have a preferable thickness ranging from ⅛ to ¼-inches, and are attached to the sides 64, 66 of the bar 58 by adhesive. Other attachment means include bands, clips, bolts, or other well-known means for attaching the above-described compressible materials to steel.

As depicted in FIGS. 1 and 3, the dowel bar 28 having resilient facings 60, 62 enables the first and second concrete slabs 14, 18 to move in relationship to the bar 28 in a direction substantially perpendicular to the resilient facings 60, 62 and substantially aligned with the axis 27 of longitudinal joint 24. Thus, the dowel bar 28 significantly reduces stresses caused by the contraction of the second concrete slab 18 and moving against an anchored bar because the resilient facings 60, 62 will compress under the stresses caused by thermal and drying contraction of the concrete. The dowel bar 28 prevents, to a large extent, the cracks that will develop in conventional installations along a line near the ends of the bars as shown in FIG. 1.

Since the improved dowel bar 28 does not have resilient facings on the top surface 68 and bottom surface 70 of the bar 28, the improved bar will restrain movement of the first and second concrete slabs 14, 16 in a direction substantially perpendicular to the outer surface 50 of the second concrete slab 18, thereby maintaining the outer surfaces of adjacent or contiguous first and second concrete slabs 14, 16 in alignment during contraction and re-expansion.

The invention provides the additional advantage of overcoming alignment problems associated with bar 28 that may not be substantially aligned with the axis 27 of the longitudinal joint 24. A non-aligned dowel may resist the sliding movement of the concrete in relationship to the dowel during contraction and re-expansion of the concrete slabs. In such circumstances, stresses caused by contraction and re-expansion may crack the surrounding concrete. The resilient facings of the present invention provide a compressible surface that would significantly reduce stresses acting on a non-aligned dowel during contraction and re-expansion of concrete.

FIGS. 6 and 7 show an alternative embodiment of the present invention. The dowel bar 76 consists of a channel-shaped bar 78 and resilient facings 96 and 98. Bar 78 has a cross section that defines a channel shape with a bottom section 79 having first and second ends 80 and 82, respectively, and upstanding flanges 84, 86 attached in an opposite spaced relationship to the first and second ends 80, 82, respectively, of the bottom section 79. Upstanding flange 84 has an inside web face 90 and an outside web face 94. Upstanding flange 86 has an inside web face 88 and an outside web face 92.

The inside web faces 88 and 90 of the upstanding flanges 86 and 84, respectively, face each other. Resilient facing 96 is attached on the outside web face 92 of upstanding flange 86. Resilient facing 98 is attached to the outside web face 94 of upstanding flange 84.

The dowel bar 76 further has a first end 100 and a second end 102. The upstanding flanges 84, 86 are centrally arranged across the joint in a direction substantially perpendicular to the joint axis to provide for movement of the concrete structures in relationship to the tying bar 76 in a direction substantially perpendicular to the resilient facings 96, 98. The bar 78 is sized as required to match the forces tending to change the lengths of the concrete and to transfer the loads between concrete sections.

With the construction of the present invention, it is possible to use bars of different cross-sections, lengths and configurations. Thus, while there has been set forth a preferred embodiment of the invention, it is to be understood that the invention is limited only by the following claims and their equivalents.

What is claimed is:

1. An improved dowel or tying bar for transferring stresses across a joint between concrete structures and accommodating for shrinkage or expansion the concrete structures, the joint defining an axis, the improved bar having sides and a first and second end, the sides of the bar embedded in the concrete structures and arranged across the joint in a direction substantially perpendicular to the axis defined by the joint, and the bar further having a resilient facing attached to at least one side of the bar to provide for movement of the concrete structures in relationship to the bar in a direction substantially perpendicular to the resilient facing and substantially aligned with the joint axis.

2. The improved bar of claim 1 wherein a resilient facing is attached to at least one end of the bar.

3. The improved bar of claim 1 wherein a resilient facing is attached to two opposed sides of the bar.

4. The improved bar of claim 1 wherein the bar is a tie bar.

5. The improved bar of claim 1 wherein the bar has a cross section substantially parallel to the axis defined by the joint, the cross section defines a substantially rectangular shape.

6. The improved bar of claim 1 wherein the bar has a cross section substantially parallel to the axis defined by the joint, the cross section defines a channel shape comprising a bottom section having first and second ends and upstanding flanges attached in an opposite spaced relationship to the first and second ends of the bottom section, each upstanding flange having an inside and outside web face, the inside web faces of the upstanding flanges facing each other.

7. The improved bar of claim 6 wherein the resilient facing is attached to the outside web face of at least one of the upstanding flanges.

8. The improved bar of claim 1 wherein the resilient facing is a plastic material.

9. The improved bar of claim 1 wherein the resilient facing is a rubber material.

10. An improved joint construction for transferring stresses across a joint between concrete structures and accommodating for shrinkage or expansion of the concrete structures, the joint defining an axis, the improved joint construction characterized by a plurality of dowel bars embedded in the concrete structures and having sides arranged across the joint in a direction substantially perpendicular to the joint axis and first and second ends, and each bar further having a resilient facing attached to at least one side to provide for movement of the concrete structures in relationship to the bars in a direction substantially perpendicular to the resilient facing and substantially aligned with the joint axis.

11. The improved joint construction of claim 10 wherein a resilient facing is attached to at least one end for each of the bars.

12. The improved joint construction of claim 10 wherein the bars are tie bars.

13. The improved joint construction of claim 10 wherein the bars have a resilient facing attached to two opposed sides of the bars.

14. An improved dowel bar for transferring stresses across a joint between slabs of a concrete pavement and accommodating for shrinkage or expansion of the slabs, the joint defining an axis, the improved bar having sides and a first and second end, the sides of the bar embedded in the concrete slabs and arranged across the joint in a direction substantially perpendicular to the axis defined by the joint, and the bar further having a resilient facing attached to at least one side of the bar to provide for movement of the concrete slab in relationship to the bar in a direction substantially perpendicular to the resilient facing and substantially aligned with the joint axis.

15. The improved bar of claim 14 wherein a resilient facing is attached to at least one end of the bar.

16. The improved bar of claim 14 wherein a resilient facing is attached to two opposed sides of the bar.

17. The improved bar of claim 14 wherein the bar is a tie bar.

18. The improved bar of claim 14 wherein the bar has a cross section substantially parallel to the axis defined by the joint, the cross section defines a substantially rectangular shape.

19. The improved bar of claim 14 wherein the bar has a cross section substantially parallel to the axis defined by the joint, the cross section defines a channel shape comprising a bottom section having first and second ends and upstanding flanges attached in an opposite spaced relationship to the first and second ends of the bottom section, each upstanding flange having an inside and outside web face, the inside web faces of the upstanding flanges facing each other.

20. The improved bar of claim 19 wherein the resilient facing is attached to the outside web face of at least one of the upstanding flanges.

21. The improved bar of claim 14 wherein the resilient facing is a plastic material.

22. The improved bar of claim 14 wherein the resilient facing is a rubber material.

23. An improved joint construction for transferring stresses across a joint between slabs of a concrete pavement and accommodating for shrinkage or expansion of the concrete slabs, the joint defining an axis, the improved joint construction characterized by a plurality of bars embedded in the concrete slabs and arranged across the joint in a direction substantially perpendicular to the axis defined by the joint, the bars having sides substantially perpendicular to the joint axis and first and second ends, and each bar further having a resilient facing attached to at least one side to provide for movement of the concrete slabs in relationship to the bars in a direction substantially perpendicular to the resilient facing and substantially aligned with the joint axis.

24. The improved joint construction of claim 23 wherein a resilient facing is attached to at least one end for each of the bars.

25. The improved joint construction of claim 23 wherein the tying bars are tie bars.

26. The improved joint construction of claim 23 wherein the bars have a resilient facing attached to two opposed sides of the bars.

* * * * *